United States Patent [19]

Baum

[11] 4,073,351

[45] Feb. 14, 1978

[54] BURNERS FOR FLAME JET DRILL

[75] Inventor: Werner Baum, Canoga Park, Calif.

[73] Assignee: Pei, Inc., Malibu, Calif.

[21] Appl. No.: 694,592

[22] Filed: June 10, 1976

[51] Int. Cl.[2] ..... E21B 7/14

[52] U.S. Cl. ..... 175/14; 175/15; 175/67; 175/422

[58] Field of Search ..... 175/11, 14, 15, 67, 175/422; 60/39.66; 431/158; 266/904; 299/14

[56] References Cited

U.S. PATENT DOCUMENTS

| | | | |
|---|---|---|---|
| 2,337,087 | 12/1943 | Deck | 266/904 X |
| 2,548,463 | 4/1951 | Blood | 175/15 X |
| 3,045,766 | 7/1962 | Fleming, Jr. | 431/158 X |
| 3,169,368 | 2/1965 | Munding | 60/39.66 |
| 3,182,734 | 5/1965 | Scott | 175/14 |
| 3,482,640 | 12/1969 | Browning | 175/14 |
| 3,539,104 | 11/1970 | Cooley | 299/17 |
| 3,620,313 | 11/1971 | Elmore | 175/17 |

*Primary Examiner*—Ernest R. Purser
*Assistant Examiner*—Richard E. Favreau
*Attorney, Agent, or Firm*—Spensley, Horn, & Lubitz

[57] ABSTRACT

A burner in the form of a flame jet drill bit engine for liquid fuels is disclosed. The burner has particular utility in a flame jet drill and comprises an axially elongated body with a combustion chamber disposed therein. At least one flame jet nozzle is disposed through the body adjacent the bottom so as to communicate with the reaction chamber. At least one set of water or other liquid jet nozzles is also disposed on the bottom of the body which produce a pulsating water jet at extremely high velocities. The flame jet nozzle and the water jet nozzles are arranged and configured on the bottom of the body so as to be substantially parallel to the axis of the body. By the use of the combination of flame jets and water jets, a cutting means is produced which can cut through a wide range of amorphous and sedimentary rocks.

11 Claims, 9 Drawing Figures

Fig. 5
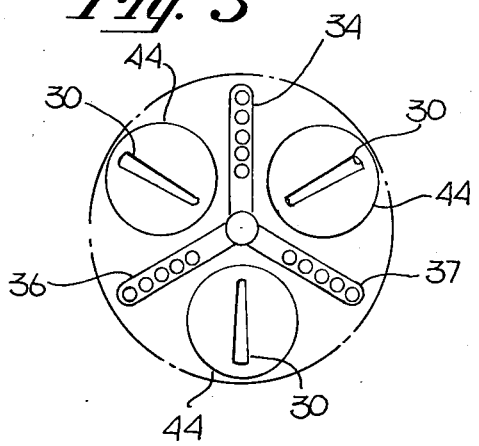
Fig. 6
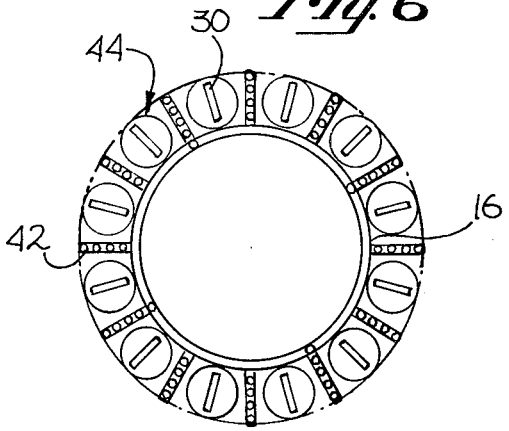
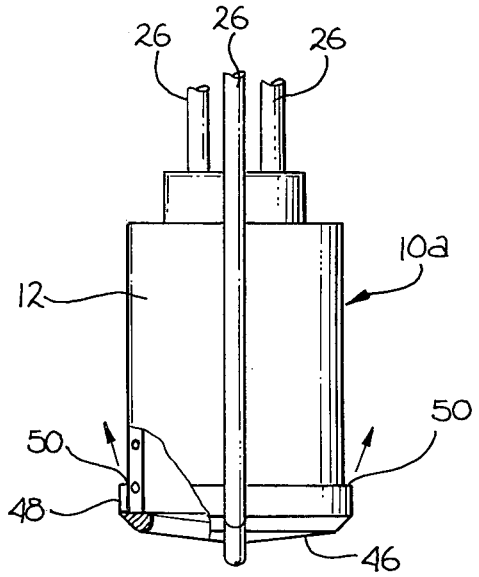
Fig. 7
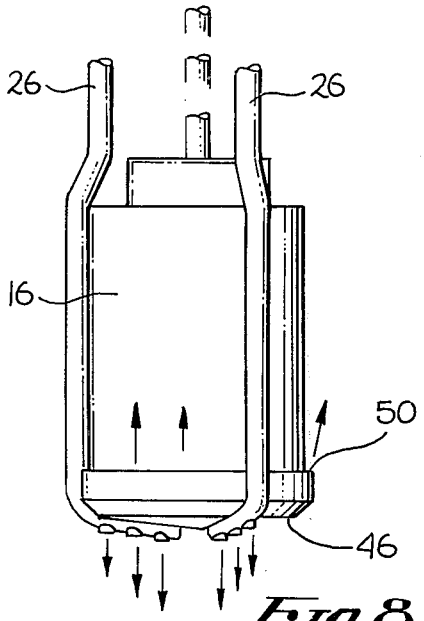
Fig. 8
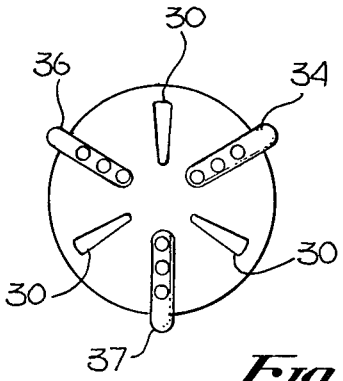
Fig. 9

BURNERS FOR FLAME JET DRILL

BACKGROUND OF THE INVENTION

1. Field of the Invention

The present invention relates to drill bit engines, and more specifically, to drill bits and drill bit engines having particular utility in drilling through a variety of materials.

2. Prior Art

The need for drill bits to drill through a wide variety of rocks is well known in the art. This problem is compounded by the fact that, for example, in the drilling of a typical oil well, different types of earth formations are encountered as the drill extends into the earth's surface. While the first layer of earth mostly may be relatively easy to penetrate, the additional layers may present conditions where the drill bit will no longer properly function. Of course, even when drilling a hole in a relatively homogeneous type of material, large rock formations can also be encountered which will break the drill bit or otherwise prevent the drill bit from penetrating therethrough. This has led the prior art to design the wide variety of drill bits which use various types and shapes of drilling heads. The most common of these are drilling heads including a plurality of outwardly extending tooth-like members disposed on the bottom of the bit which tooth-like members rotate in varying directions. Upon engagement of the earth's surface, the members "eat" their way through the earth and thus form the well hole. However, the problems associated with such a drill bit are many. One of the most critical is that while such teeth can go through certain types of rock, the speed at which they go through hard rock is extremely slow which tends to wear the teeth down. This has necessitated the replacement of such drilling heads many times before such rock is finally penetrated.

As the need for exploration of natural resources increases, the need to find a better system for drilling in a wide range of environments has also increased. One recent development has been the use of liquid fuels and an associated jet nozzle to produce a high temperature flame. The flame is used as the cutting means by which the drill proceeds through the ground. An example of such type of drill bit is disclosed by Elmore, U.S. Pat. No. 3,620,313. In the Elmore device, a liquid propellant is burned in bulk mode to produce high combustion pressures with a relatively large power output. Such energy density produced by the buring of the liquid propellant enable the device to drill relatively deep holes. In the use of such a device, the fuels used have been hydrazine, diesel fuel, nitric acid and the like. While such flame drills have been found to be particularly useful in drilling a wide variety of rocks, the rate at which these type of drills have proceeded through the earth's surface has not been as rapid as initially anticipated. It has been determined that the problem encountered by such a drill bit is that the surface adjacent the nozzle of the flame tends to melt and cool the rock before it is carried away. This melted rock formation has a thermal conductivity range which is many times broader than the initial rock formation. In other words, the melting action of the rock produces a barrier adjacent the drill bit nozzle which decreases the rate at which the nozzle can proceed.

Other prior art device is disclosed by Fleming, U.S. Pat. No. 3,045,766. In the Fleming device, a burner is disposed adjacent the bottom thereof and is used as a means for penetrating the ground. The Fleming device also includes a cooling system in which cooling waters flow through various passages adjacent the burner and discharge adjacent the burner tip in a generally upward direction. Because of the heat associated with the flame jet, the water is converted into steam which contacts the rock. The cooling water and the steam thus produced is described as being the medium for carrying the cuttings out of the hole. Moreover, as discussed with the other prior art, Fleming makes no reference to the use of an additional jet as a means for increasing the rate at which the drill bit can be used to penetrate the rock formation.

The present invention represents an advancement in the art of rock piercing means and contains none of the aforementioned shortcomings associated with the prior art devices. The present invention thus provides an apparatus which can be used for a wide variety of rock formations and which uses a combination of water jet piercing and flame jet piercing techniques. By the use of this combination, unexpected speed through various types of rocks is achieved.

BRIEF SUMMARY OF THE INVENTION

The present invention relates to rotary drill bit engine for liquid fuels, and more specifically, to a drill bit engine having particular utility in a flame and water jet drill. The drill comprises an axially elongated cylindrical body with a combustion chamber having a generally circular cross section disposed therein. The combustion chamber is able to withstand high temperatures such as those associated with a typical rocket engine and has a plurality of flame jet nozzles disposed through the body adjacent the bottom thereof so as to communicate with the reaction chamber. A plurality of water jet nozzles are also disposed on the body adjacent the bottom thereof and are adapted to produce a pulsating stream of water projectiles at high velocities. The flame jet nozzles and the water jet nozzles are arranged and configured in an alternating configuration and are substantially parallel to the axis of the body. A coolant wash opening is also provided on the bottom of the body which helps cool off the drill bit and can help carry away the material loosened by the drill bit action. The coolant wash opening is configured so as to be in a generally upward direction and makes an obtuse angle with respect to the flame jet nozzles.

In operating the engine of the present invention, a flame jet lance which may be self-contained and which has various reactant tanks and water tanks disposed therein is coupled to the rocket drill bit engine. The lance is lowered into the ground at which time various controls in the drill bit engine are activated either from the surface or from controls within the lance. Upon activation, fuel is pumped from the lance to the drill bit engine where it is ignited in the reaction chamber. The flames spew out at extremely high velocities and impinge upon the ground adjacent the flame jet nozzle. As the flames spew out, rock and the like are caused to disintegrate. However, as discussed hereinabove, melting of the rock would otherwise take place but for the associated water jet nozzles which shoot a water projectile at extremely high velocities on the surface to be drilled. This action creates spalling of the rock which increases the rupturing thereof and thus enables a mechanical and thermal shock of the rock to take place. It is known that the swelling of diverse kinds of rock is a function of many physical and thermal characteristics.

One of the major causes for the ruptures in swelling of rock is made through the reaction of thermal stresses via heat supply. This takes place, on the one hand, through the different expansion of heated and non-heated rock particles and on the other hand, through different thermal expansion of crystals and kernels from which rock is formed. High heat gradient in the rock and different expansion co-efficients of different minerals likewise affect spalling. To increase the likelihood of spalling, the present invention heats the rock via high temperature flame jets and simultaneously cools and cuts the rocks via the water jet projectiles. One object of the present invention is therefore to increase the spalling effect through amplification of temperature differences. The influence of the bending stresses on the edges of the rock formation which cause the spalling are therefore significantly increased. Thus, the specific configuration of the flame jet nozzles and the coolant jet nozzles is important vis-a-vis creating the necessary spalling. While the prior art may have been aware of the desirablility of increasing such spalling, it was not until the specific configuration of the drill bit nozzles of the present invention, and more particularly, the configuration of the water jet nozzles and flame jet nozzles which have achieved significant increases and such spalling action.

Novel features which are believed to be characteristic of the invention, both as to its organization and method of operation, together with further objectives and advantages thereof will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention. dr

BRIEF DESCRIPTION OF THE DRAWINGS

FIG. 5 is a bottom view of the rocket drill bit engine showing another embodiment for the configuration of the flame jet nozzles and water jet nozzles.

FIG. 6 is a bottom view of the rocket drill bit engine showing yet another embodiment for the flame jet nozzles and water jet nozzles.

FIG. 7 is a view of a rocket drill bit engine having a substantially flat bottom member.

FIG. 8 is a side view of the rocket drill bit engine shown in FIG. 7 showing the associated water jet nozzle conduit lines.

FIG. 9 is a bottom view of the rocket drill bit engine shown in FIGS. 7 and 8, and indicating the configuration of the flame jet nozzles and water jet nozzles.

DETAILED DESCRIPTION OF THE INVENTION

Figure 1:
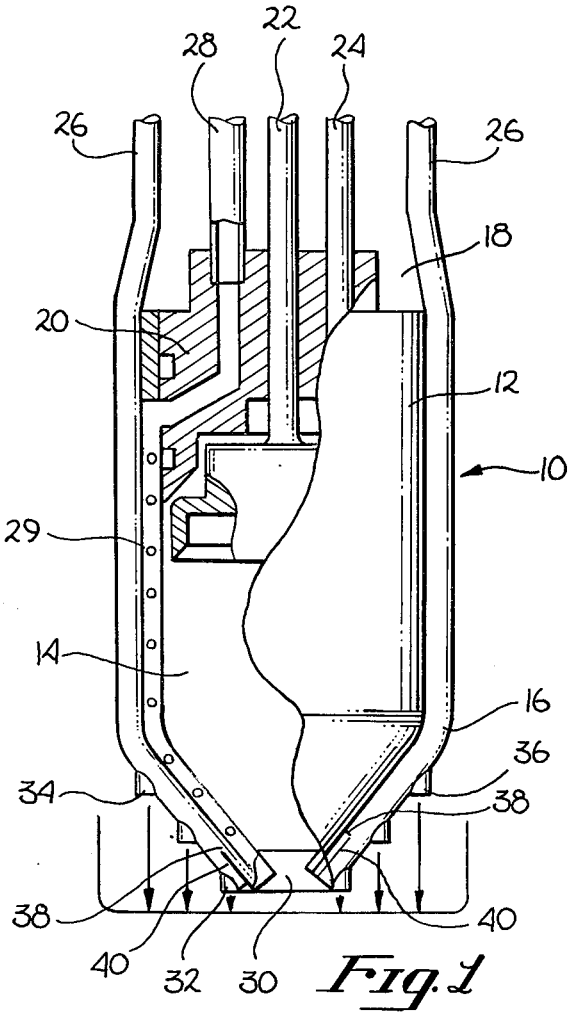
FIG. 1 is a cutaway front view of the drill bit engine of the present invention showing the reaction chamber disposed therein.

Referring first to FIG. 1, the novel drill bit engine 10, for liquid fuels is clearly shown. The engine 10 is comprised of an axially elongated cylindrical body 12 having a reaction chamber 14 disposed therein. Such reaction chamber is capable of withstanding flame jet combustion such as those produced by the reaction of an oxidizer and a fuel. In the presently preferred embodiment, the reaction is between nitric acid and diesel oil, and is well known in the art. One such combustion chamber which can be adapted and used in combination with the other elements of the present invention hereinbelow is described by Munding, U.S. Pat. No. 3,169,368 which is herein incorporated by reference. In the Munding disclosure, the combustion chamber construction and operation is set forth. A rocket engine is described which has a combustion chamber and includes means for directing a cooling agent tangentially in the combustion chamber under high velocity conditions in which the cooling agent is directed around the walls thereof. While such cooling action has been found to be beneficial with respect to the interior of the rocket engine, there has been found to be a need to further cool the rocket engine and such need is provided for as discussed hereinbelow.

Another type of rocket propellant injection and cooling system is discussed by Munding, U.S. Pat. No. 3,459,001 which is also herein incorporated by reference. In the Munding U.S. Pat. No. 3,459,001 the problem associated with such high combustion chambers are discussed. In the Munding U.S. Pat. No. 3,459,001 device, liquid oxygen or an oxygen carrier is fed as a coolant by tangential introduction into a turbulence chamber arranged at the inner end of the combustion chamber in a concentric position to discharge through a constrictive cross section against the walls of the combustion chamber. The constriction includes means for directing fuel centrally through a nozzle extending in the axial direction of the combustion chamber with an orifice such that the fuel issues concentrically in a cone angle of less than 100° and is directed against the oxygen film on the interior wall of the combustion chamber but does not have sufficient pressure and force to penetrate this film. The fuel is introduced by preheating it through a nozzle area which also provides a cooling effect on the walls of the combustion chamber. Oxygen or oxygen carriers are then directed through an annular opening at a force and velocity to insure that the fuel component will remain close to the end wall and also to be directed around the end wall in a desirable flow stream and therefter adhere to the side walls of the combustion chamber along the length thereof up to the nozzle portion thereof. The fuel itself is advantageously directed through a conduit after being preheated in the nozzle. The fuel is directed toward the film of oxygen at an angle in force, however, which insures that it does not penetrate the film. The cone angle of such centrally introduced fuel is such that the fuel will be carried along in an axially flowing direction along the combustion chamber wall along with the oxygen.

As discussed hereinabove, the present invention, while capable of using such combustion chambers, can use other combustion chambers such as are readily known in the art.

The body 12 of the engine 10 has a bottom 16 and a top 18. The bottom 16, in the first preferred embodiment, has a generally chisel-like shape which has been found to be particularly advantageous in penetrating various rock formations and provides an inclined surface for easily mounting various jet nozzles thereto. A bearing member 20 is disposed above the chamber 14 and is connected to a rotatable shaft 22 which shaft is coupled at one end thereof to the chamber 14. In this manner, the entire chamber 14 is rendered rotatable such that the associated flame jet nozzles 30 are also rendered rotatable. Such rotation system may of course include various gearing mechanisms and bearings which will not be described in detail herein and which are well known in the prior art.

Reaction conduit 24 carries the necessary reactants to the reaction chamber 14 where they are selectively reacted so as to produce the flame jet and associated flame jet temperatures. A water jet line 26 is disposed adjacent the periphery of the body 12 and extends along the length thereof including the tapered bottom section 16 terminating adjacent the flame jet nozzle 30. Finally, coolant wash conduit 28 also extends through the top 18 of the engine 10 and terminates in a water jacket 29 disposed about the entire reaction chamber 14.

Figure 2:
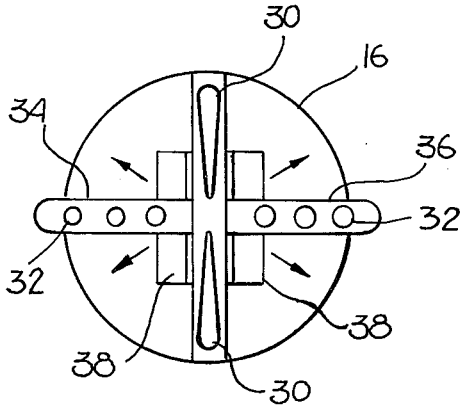
FIG. 2 is a bottom view of the drill bit engine of the present invention showing the flame jet nozzles and water jet nozzles.

Referring now to FIG. 2, the bottom 16 of the engine 10 is clearly indicated. The bottom 16 is shown as having a first set 34 and a second set 36 of water jet nozzles 32. While such jet nozzles 32 are preferably run with water, other liquids, such as liquid nitrogen and the like are also within the scope of this invention. FIG. 2 also indicates that in this embodiment two opposed flame jet nozzles 30 are provided. It has been found that a particularly good configuration for producing very rapid cutting is to locate all the nozzles 30 and 32 such that they are parallel to the axis of the body 10. Moreover, it has been found that in one embodiment good drilling is achieved when the first and second sets of coolant jet nozzles, 34 and 36 respectively, and the two flame jet nozzles 30 are arranged on the bottom 16 in an alternating configuration and at right angles with respect to each other in the transverse plane.

Figure 3:
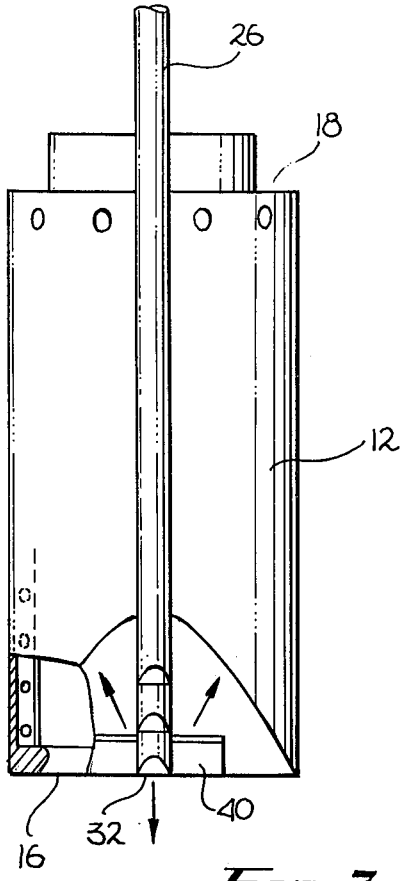
FIG. 3 is a side view of the rocket drill bit engine showing the coolant and jet water conduit lines.

Referring now to FIGS. 1, 2 and 3, one can see that coolant is wash jacket 29 terminates adjacent the flame jet nozzle 30 in a generally upward direction and is caused to be sprayed out of the engine 10 through wash openings 38. Wash openings 38 are formed by upwardly extending flange-like members 40. These wash openings 38 help cool the reaction chamber 14 as well as help carry loosened rocks and the like, especially if the coolant is, for example, liquid nitrogen, to the surface of the ground. Shown in FIGS. 1, 3 and 7 are a plurality of small circular designations generally disposed in element 29 adjacent the periphery of the body 12. These are small circular air bubles which are inserted in such figures merely to better show the pathway of the coolant wash water and the manner in which it flows about the reaction chamber 14 as hereinabove described.

In operating the drill bit engine 10 of the first embodiment of the present invention, the drill bit engine 10 is coupled to an associated lance adjacent the bottom thereof. Such lances generally have a self-contained readily complete fuel system including the oxidizer tank, if necessary, and the related fuel tanks. Such lance can also include pumping means for pumping the various fuels to the reaction chamber 14 or inert gas tanks to force the fuels to chamber 14. A water tank and associated water pumping system for pumping both the jet water and the coolant wash water to the respective lines 26 and 28 in the engine 10 are also disposed in the lance. The various tanks and pumps of the drilling lance are well known in the art and will not be discussed in detail herein. In another embodiment of the present invention, such tank systems are not disposed within the lance; rather connecting lines extending from the surface to be drilled to the lance are directly coupled to the engine 10. In this manner a substantially longer drilling time can be achieved. However, when the depth of a hole or other related considerations make the use of such ground system undesirable, the tanks can be disposed within the lance.

As the lance is lowered into the hole to be drilled the reactants are caused to be pumped into the reaction chamber 14 where they are ignited. The ignition of the reactants causes a flame jet of jet engine temperatures and velocity to begin spewing out of flame jet nozzle 30. The specific configuration of the flame jet nozzle is that of a typical jet nozzle and various different types of nozzles are within the scope of this invention. The shaft 22 is activated by an associated motor in the lance and begins to rotate thereby rotating that section of the engine 12 containing the flame jet nozzle 30. Cooling wash water begins to flow through the associated conduit 28 which flows into jacket section 29 which helps reduce the undesirable temperature build-ups outside of the reaction chamber 14. Moreover, as the wash water exits from the jacket 29 through wash opening 38, it is caused to travel in a generally upward direction so as to make a generally obtuse angle with respect to the flame jet nozzle. Such direction has been found to further increase the necessary cooling of the chamber 14. Moreover, while such flow rate through opening 38 is not at jet engine velocities, it is of a substantial velocity so as to pick up particles of dirt, rock and the like and carry them away from the area adjacent the various nozzles.

A fluid, preferable water, under very high pressure is also caused to flow through the water jet conduit lines 36 and exit from the various sets of water jet nozzles 34 and 36, respectively, at very high pressures. In the presently preferred embodiment, pressures of up to 100,000 atmospheres of water pressure at a velocity of from 2,000 to 5,000 meters per second or even greater are achieved.

The water jet nozzles 32 do not form a continuous stream of water; rather, the water jets are pulsed out at the rate of approximately one pulse per second. This has been found to be particularly desirable in that such rate creates the necessary spalling but does not require the need for the use of great quantities of water which would reduce the efficiency of the flame jet.

Figure 4:
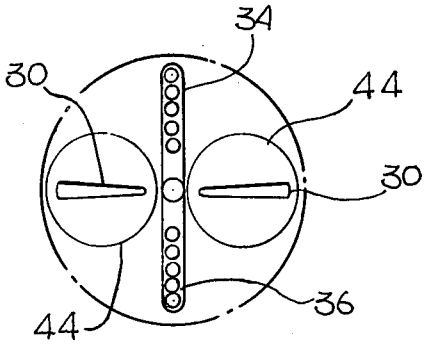
FIG. 4 is a bottom view showing a different configuration for the flame jet nozzles and water jet nozzles.

Shown in FIG. 4 is another configuration for the flame jet nozzles 30 and the water jet nozzles 32. In this configuration, two jet nozzles 30 and two sets of water jet nozzles 34 and 36 are arranged in an alternating relationship. In addition, the two flame jet nozzles 30 are disposed in rotatable members 44.

Shown in FIG. 5 another configuration for the flame jet nozzles 30 and water jet nozzles 32 is shown. In this configuration, three flame jet nozzles 30 and three sets of water jet nozzles, sets 34, 36 and 37, are arranged and configured such that in an alternating and symmetrical configuration, with each jet nozzle 30 and each set of water jet nozzles spaced 120 degrees respectively. In this configuration, flame jets 30 are disposed in rotatable members 44. Members 44 enable such configuration to obtain the advantages of a rotating flame jet drill.

Finally, in FIG. 6 yet another configuration of the nozzles is shown with a plurality of coolant jets alternating with a plurality of flame jets. The flame jets 30 are disposed adjacent the periphery of the bottom 16 and are preferably disposed in rotatable member 30 which permits such nozzles to rotate. Plurality of water jets represented generally by the numeral 42 are also disposed adjacent the periphery of bottom 16.

The above configuration of water jet nozzles and flame jet nozzles have been determined to have special advantages in drilling through extremely hard rock. Of course, other configurations are within the scope of this invention.

Referring now to FIGS. 7, 8 and 9, a second configuration for the body 12, and more specifically, the bottom of the engine 10 is shown. In this configuration, the bottom 46 is not chisel-shaped, but rather has a substantially flat appearance but does have a slight arcuous shape. In this configuration, the water wash opening 50 is disposed adjacent the periphery of the body 12 such that a continuous stream of water exudes out of the wash opening 50 formed by the flange member 48. The water to wash opening 50 is supplied via conduit 28 and coolant wash jacket 29 as discussed hereinabove. This has been found particularly useful in keeping the temperature of the drill bit sufficiently low as to prevent damage thereto, as well as in carrying away particles of rocks and other material. As discussed hereinabove, first, second and third sets of water jet nozzles, elements 36, 38 and 39, respectively, are disposed against the periphery of the engine 10*a* and act as the same manner hereinbove described. It should be noted that in FIGS. 1, 2, 3, 7 and 8 various arrows are shown. These arrows indicate the direction of flow of water through the various orifices. For example, in FIG. 1, the arrows indicate the flow of water (or other coolant) through the first and second set, 34 and 36 respectively, of the water jet nozzles 32. In FIGS. 2 and 3, the upwardly directed arrows indicate the flow of the coolant water which is exiting out of wash openings 38.

Although the invention has been disclosed and described with reference to particular embodiments, the principles are susceptible of other applications which will be apparent to other persons skilled in the art. The specific utility of the present invention is that of forming holes by a combined use of water jets and flame jets. Such flame jet temperatures and pressures are well known in the art. For example, typical characteristics of the flame jet nozzles are as follows:

| | | |
|---|---|---|
| Thermal output per second | | 5560 kJ/s |
| Mechanical output of the exhaust stream on jet nozzle | | 515 kJ/s |
| Mechanical output in rock | | ca. 1400 kJ/s |
| Mixture ratio $= \frac{m\ HNO_3}{m\ \text{diesel oil}}$ | | $= 5.54$ |
| Specific propellant consumption (granite) | | $m_g - 2.38\ g/cm^3$ |
| Propellant comsumption | | $m = 0.950\ kg/s$ |
| Propellant volumes | | $V_P = 0.17\ l/s$, $V_{ox} = 0.52\ l/s$ } $V_g = 0.69\ l/s$ |
| Lance's burning time | | $t = 6$–$30$ minutes |
| Rate of drilling (maximal): | | |
| sandstone | 92 m/h | |
| granite | 21 m/h | |
| basalt | 18 m/h | |
| bore diameter | variable | |

It has been found that the water jet pressures should be up to approximately 100,000 atmospheres at the point of drilling in order to achieve the necessary combination effect between the water jet nozzles and the flame jet nozzles. Such water jet nozzles have a velocity of from 2,000 and more meters per second and a pulse rate of approximtely one pulse per second. It is this combination of flame jet nozzles and water jet nozzles which enables the drill bit of the present invention to cut through extremely hard surfaces at a very high rate. Of course, other configurations for the flame jet nozzles and water jet nozzles other than those discussed hereinabove are within the scope of this invention. This invention, therefore, is not intended to be limited to the particular embodiments herein disclosed.

I claim:

1. A rotatably mounted drill bit engine for liquid fuels having particular utility in a flame jet drill comprising an axially elongated body with a combustion chamber disposed therein, at least one flame jet nozzle opening through said body adjacent the bottom thereof so as to communicate with said combustion chamber, and a first set of liquid jet nozzles disposed on said engine adjacent said bottom thereof, said flame jet nozzle and said first set of liquid jet nozzles mounted substantially parallel to the axis of said body, said first set of liquid jet nozzles configured to direct a pulsating stream of liquid jet projectiles at high velocities such that as said engine is rotated, the area adjacent the bottom of said engine is subjected to flame jets and pulses of liquid projectiles at predetermined intervals whereby spalling of rock and the like is encouraged.

2. A rotatably mounted drill bit engine according to claim 1 wherein said liquid projectiles are pulsed out of said first set of liquid jet nozzles at the rate of one pulse per second.

3. A rotatably mounted drill bit engine according to claim 1 wherein said water projectiles have a velocity of approximately 2,000 to 5,000 meters/second.

4. The drill bit engine of claim 1 wherein, in addition thereto, at least one coolant wash opening is provided adjacent said bottom of said body, said coolant wash opening being directed in a generally upward direction so as to make an obtuse angle with respect to said flame jet nozzle.

5. The drill bit engine of claim 1 wherein said drill bit has two flame jet nozzles and first and second sets of liquid jet nozzles, said flame jet nozzles and said first and second sets of liquid jet nozzles arranged on said bottom of said body in an alternating and symmetrical configuration.

6. The drill bit engine of claim 5 wherein each of said flame jet nozzles and each of said liquid jet nozzles extends radially along said bottom of said body.

7. The drill bit engine of claim 1 wherein said drill bit has two flame jet nozzles, and first, second, and third sets of liquid jet nozzles, said flame jet nozzles and said first, second and third sets of liquid jet nozzles arranged on said bottom of said body in an alternating and symmetrical configuration.

8. The drill bit engine of claim 7 wherein each of said flame jet nozzles and each of said liquid jet nozzles extends radially along said bottom of said body.

9. The drill bit engine of claim 1 wherein said drill bit has a plurality of flame jet nozzles and a plurality of sets of liquid jet nozzles arranged on said bottom of said body adjacent the periphery thereof.

10. The drill bit engine of claim 9 wherein each of said flame jet nozzles and each of said liquid jet nozzles extends radially along said bottom of said body.

11. A rotatably mounted drill bit engine for liquid fuels having particular utility in flame jet drills comprising an axially elongated body with a combustion chamber disposed therein, at least one flame jet nozzle opening through said body adjacent the bottom thereof so as to communicate with said combustion chamber, and a first set of liquid jet nozzles mounted substantially parallel to the axis of said body, said first set of liquid jet nozzles configured to direct a pulsating stream of liquid jet projectiles at high velocities such that as said engine is subjected to flame jets and pulses of liquid projectiles at predetermined intervals whereby spalling of rock and the like is encouraged, said liquid being directed to said first set of liquid jet nozzles through a conduit extending along the periphery of said body.

* * * * *